United States Patent [19]

Funke et al.

[11] 4,144,906

[45] Mar. 20, 1979

[54] PROGRAMMABLE FLUIDIC PRESSURE-TO-ELECTRONIC INTERFACE SYSTEM

[75] Inventors: Maurice F. Funke, Columbia, Md.; John M. Goto, Falls Church, Va.

[73] Assignee: The United States of America as represented by the Secretary of the Army, Washington, D.C.

[21] Appl. No.: 815,624

[22] Filed: Jul. 14, 1977

[51] Int. Cl.[2] ..... F15C 1/12

[52] U.S. Cl. ..... 137/819

[58] Field of Search ..... 137/819

[56] References Cited

U.S. PATENT DOCUMENTS

| | | | |
|---|---|---|---|
| 3,369,557 | 2/1968 | Wood | 137/815 |
| 3,465,774 | 9/1969 | Kautz et al. | 137/833 |
| 3,572,357 | 3/1971 | Philbrick | 137/805 |
| 3,957,233 | 5/1976 | Adams | 137/819 X |

*Primary Examiner*—William R. Cline

*Attorney, Agent, or Firm*—Nathan Edelberg; Robert P. Gibson; Saul Elbaum

[57] ABSTRACT

A programmable fluid logic module is disclosed which provides an interface between a plurality of fluid input signals in a pressure-to-electric transducer. The module is arranged so that a plurality of valves may be used to provide a particular combination of signals which result in the transmission of a desired signal from the module to a pressure-to-electric transducer.

4 Claims, 3 Drawing Figures

PROGRAMMABLE FLUIDIC PRESSURE-TO-ELECTRONIC INTERFACE SYSTEM

RIGHTS OF THE GOVERNMENT

The invention described herein may be manufactured, used, and licensed by or for the United States Government for governmental purposes without payment to us of any royalty thereon.

BACKGROUND OF THE INVENTION

The instant invention relates generally to monitoring and control systems for production lines. Such systems require that a potentially large number of digital pneumatic outputs from sensors, valves, actuators, and fluidic (moving and no moving part) logic devices be interfaced to electronic control systems. This could mean an equally large number of pressure-to-electric (P-E) switches to transduce these signals. There is no technical problem in transducing these signals; however, transducers of this type are generally recognized as weak points in the long term reliability of any system used to sense and control machine functions. The presence of a large number of these transducers in production control systems in therefore an undesirable situation.

The prior art as exemplified by U.S. Pat. No. 3,572,357, to Philbrick, teaches means to couple multiple fluidic inputs to a single pressure to-electric transducer. Such systems are designed for a particular set of inputs and outputs.

SUMMARY

The present invention describes a utilization of fluidic technology to provide a simplified interface between pneumatic signals from a production process and an electronic controller. When numerous digital pneumatic signals are required to determine the condition at a particular process station on a production line, fluidic logic can be utilized to reduce the required number of pressure-to-electric transducers. This in turn increases the long term reliability of the control system. Further, the present invention describes an interface system which is programmable and thus useful in many different production line situations.

The advantages presented by this invention are many. First, each module used eliminates the need of one or more P-E transducers, thus increasing system reliability. Second, the use of no-moving-part fluidic logic provides a reliable, inherently explosion proof device to perform the needed logic function. The particular design embodied in the examples presented is very simple in nature yet it lends itself to standardization and modularization, with their attendent advantages of low cost (eliminating the need for custom design for each application) and simplified maintenance or replacement.

DESCRIPTION OF THE PREFERRED EMBODIMENT

Figure 1:
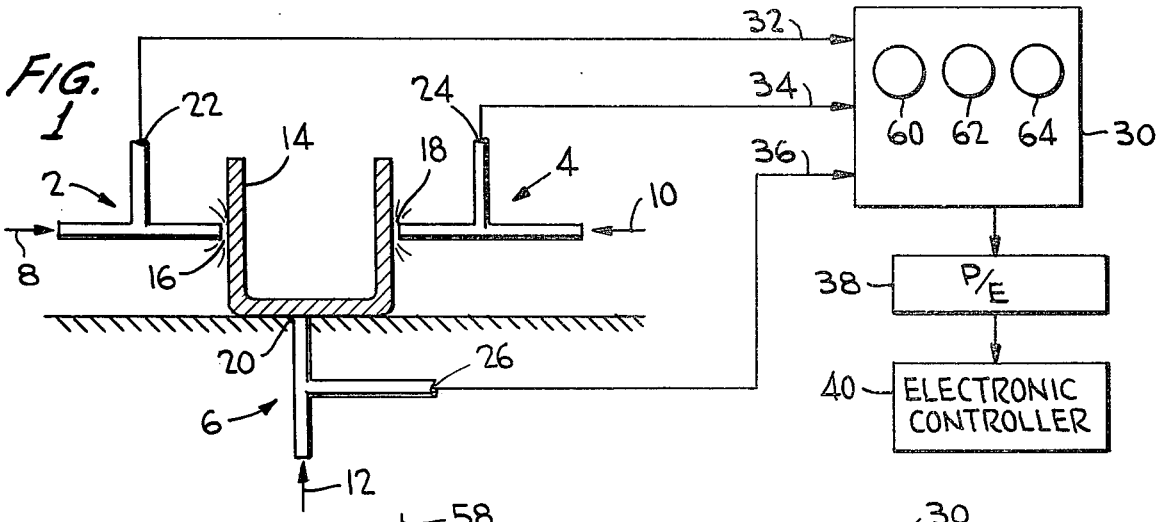
FIG. 1 is a diagram of the interface system of the instant invention installed in a typical production line situation.

Referring now in greater detail to the drawings in which similar reference numerals refer to similar elements, FIG. 1 depicts a system having three back pressure sensors, 2, 4, and 6. The back pressure sensors 2, 4, and 6 have inlets 8, 10, and 12 connected to a pressure source. The back pressure sensors are arranged so that when a production part 14 is in its proper position it will block outlets 16, 18, and 20 thereby producing an output in branch lines 22, 24 and 26. These branch lines lead to interface module 30 and are connected to inlets 32, 34, and 36. Interface module 30 is programmable by means of valves 60, 62, and 64 to produce an outlet to pressure-to-electric transducer 38 when the desired combination of signals are present at the inlets to module 30. The outlet from pressure-to-electric transducer 38 may then be fed to electronic controller 40 or other utilization means. Though interface module 30 is illustrated handling three input signals, it is obvious that a module could be built to handle any number of input signals.

Figure 2:
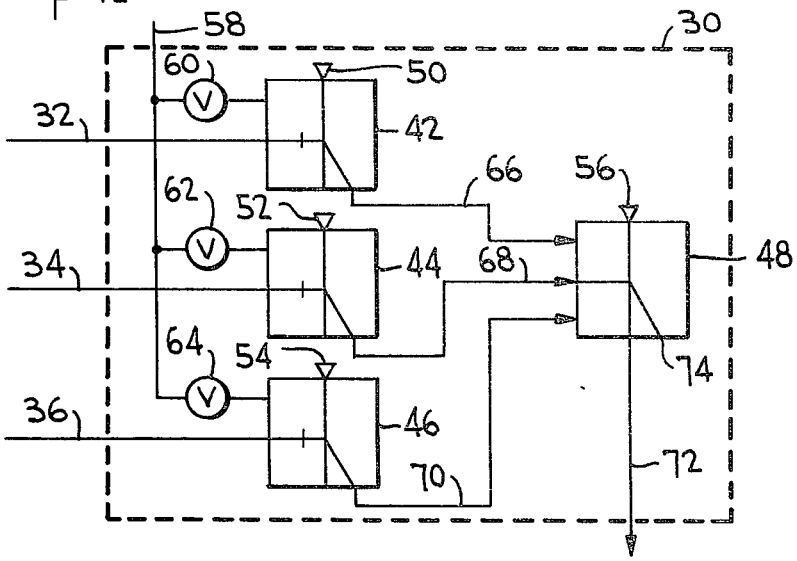
FIG. 2 illustrates a preferred embodiment of the interface system.

Interface module 30 is shown in greater detail in FIG. 2. The module includes three fluidic 'Exclusive/OR' logic devices 42, 44 and 46 as well as one fluidic 'OR/-NOR' logic device 48. These fluidic logic devices receive fluid from supply manifold 58 at their power nozzles 50, 52, 54 and 56. The 'Exclusive/OR' devices 42, 44 and 46 receive control inputs from supply manifold 58 through programming valves 60, 62 and 64 as well as signals from the production process through inlets 32, 34 and 36. The ON outputs from the 'Exclusive/OR' logic devices 42, 44 and 46 are connected by lines 66, 68 and 70 to the control input of 'OR/NOR' device 48. Either the ON output or the OFF output from 'OR/-NOR' device 48 may be used as a control output.

The operation of the interface module of FIG. 2 is as follows: The digital pneumatic output signal shown from any of the three 'Exclusive/OR' devices 42, 44 and 46 will be ON only if its two input signals have different logic states; ie, one is ON and the other is OFF. The output signal from the 'OR/NOR' device will be OFF if there is an ON output from any of the 'Exclusive/OR' devices. This means that for there to be an ON output from the interface system, the signal from programming valve 60 must be the same as input 32, the signal from programming valve 62 must be the same as signal 34 and the signal from programming valve 64 must be the same as signal 36. Since the signals from programming valve 60, 62, and 64 are selectable and since it is known what signals 32, 34, and 36 are when a given occurrence (eg, part in place and orientation correct) is existant in the production process, it is possible to program the logic module described in this invention, using the programming valves, such that there is an output from this logic module (ie, its 'OR/NOR' device) if and only if a given event occurs in the production process. This programming is accomplished by setting valve 60 such that its signal equals signal 32, and likewise setting valves 62 and 64 so that their signals equal signals 34 and 36 respectively, when the event occurs.

The foregoing description explains what happens when there are three signals 32, 34, and 36 of interest in the production process. However, the concept described in this invention can be utilized to simplify the interfacing requirements for any number (greater than 1) of digital pneumatic signals from a production process required to determine the condition at a particular process station on the production line. For example, if only two such pneumatic signals (32 and 34) were required, programming valves 60 and 62 could be set as described above and programming valve 64 would be switched to the OFF state since, with no signal ever present at 36, the signal 36 can be considered to be OFF when the event occurs.

Figure 3:
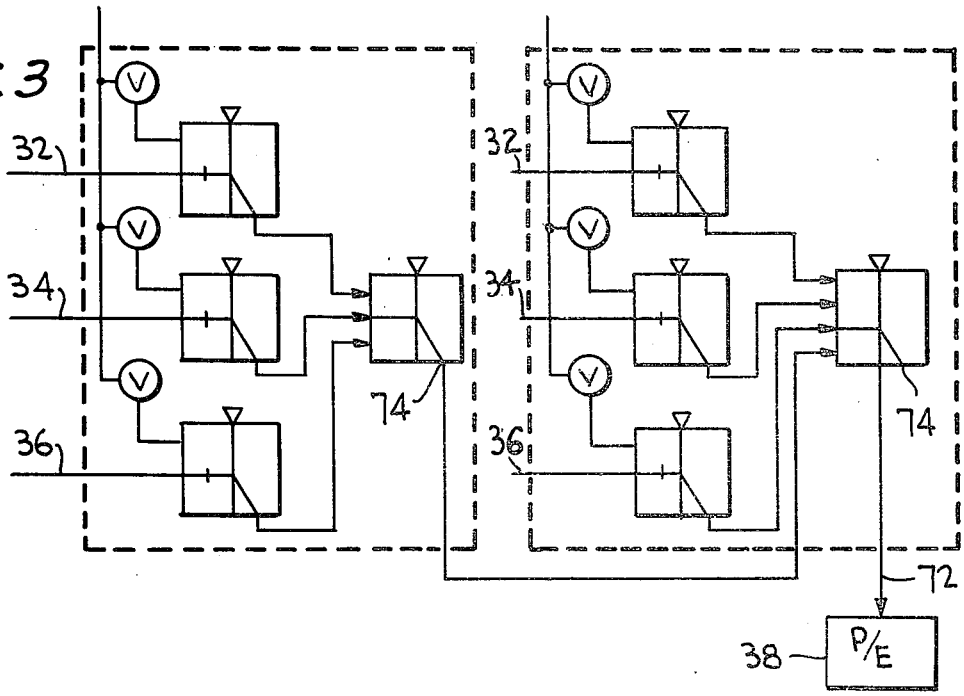
FIG. 3 is a schematic view illustrating two of the interface systems interfaced together.

If more than three signals were required, the concept described in this invention could still be utilized. This would require connecting the outlet 74 of the 'OR/-NOR' device in the first module to an input of the 'OR/-NOR' of a second module. This is shown schematically for accomodating six independent input signals in FIG. 3. Note that the pressure-to-electric transducer is now connected to the second module. Obviously, any number of input signals could be handled by this invention by merely interconnecting enough of the basic modules and connecting a single pressure-to-electric transducer to the last module in the series.

While the above description of this invention deals with modules designed to handle three input signals, the concept itself is not limited to 3-signal modules. A single module could be designed to handle any number of signals. It is also clear, from the above description, that the concept of the invention could be embodied using logic devices handling either hydraulic or pneumatic signals.

We wish it to be understood that we do not desire to be limited to the exact details of construction shown and described, for obvious modifications can be made by a person skilled in the art.

What we claim is:

1. A programmable fluid logic module for providing an interface between a plurality of fluid input signals and a pressure-to-electric transducer comprising:

a plurality of first fluidic logic devices each having first and second input channels for receiving first and second inputs and an output channel producing an output signal only when said first and second inputs are not the same and producing no output signal when said first and second inputs are the same;

first connecting means for connecting each of said first input channels to a source of supply fluid;

second connecting means for providing input signals to each of said second input channels;

a second fluidic logic device having a plurality of input channels and an output channel which produces an output signal only when any of said plurality of input channels of said second logic device receives an input signal; and third connecting means for connecting each one of said output channels of said first logic devices to one of said input channels of said second logic device.

2. The fluidic logic module of claim 1 wherein said first connecting means includes valve means for selectively isolating said first input channels from said source of supply fluid.

3. The module of claim 2 wherein said valve means includes one valve for each of said first input channels.

4. The fluidic logic module of claim 1 wherein said second fluidic logic device further includes a second output channel which produces an output signal only when none of said plurality of input channels of said second fluidic logic device receives an input signal.

* * * * *